US008262453B2

(12) United States Patent
Jubinville et al.

(10) Patent No.: US 8,262,453 B2
(45) Date of Patent: Sep. 11, 2012

(54) COMBINATION LOTTERY AND RAFFLE GAME

(75) Inventors: Chantal Jubinville, Hoboken, NJ (US); Victor Marinelli, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 425 days.

(21) Appl. No.: 11/350,245

(22) Filed: Feb. 8, 2006

(65) Prior Publication Data

US 2006/0178194 A1 Aug. 10, 2006

Related U.S. Application Data

(60) Provisional application No. 60/651,317, filed on Feb. 9, 2005.

(51) Int. Cl.
*A63F 9/00* (2006.01)

(52) U.S. Cl. ..... 463/17

(58) Field of Classification Search ..... 273/138.1
See application file for complete search history.

(56) References Cited

U.S. PATENT DOCUMENTS

| | | | |
|---|---|---|---|
| 1,527,929 | A | 2/1925 | Simons |
| 3,089,123 | A | 5/1963 | Hennis et al. |
| 3,245,697 | A | 4/1966 | BNugent |
| 3,699,311 | A | 10/1972 | Dunbar |
| 3,736,368 | A | 5/1973 | Vogelman et al. |
| 3,826,499 | A | 7/1974 | Lenkoff |
| 3,868,057 | A | 2/1975 | Chavez |
| 3,876,865 | A | 4/1975 | Bliss |
| 3,902,253 | A | 9/1975 | Sabuzawa et al. |
| 3,918,174 | A | 11/1975 | Miller et al. |
| 3,922,529 | A | 11/1975 | Orloff |
| 3,934,120 | A | 1/1976 | Maymarev |
| 4,017,834 | A | 4/1977 | Cuttill et al. |
| 4,095,824 | A | 6/1978 | Bachman |
| 4,105,156 | A | 8/1978 | Dethloff |
| 4,176,406 | A | 11/1979 | Matkan |

(Continued)

FOREIGN PATENT DOCUMENTS

| | | |
|---|---|---|
| AU | B-18428/92 | 12/1992 |

(Continued)

OTHER PUBLICATIONS

'Are You in?', (Article).

(Continued)

*Primary Examiner* — Melba Bumgarner
*Assistant Examiner* — Seng H Lim
(74) *Attorney, Agent, or Firm* — Dority & Manning, P.A.

(57) ABSTRACT

Various embodiments of system and method for implementing a combination lottery and raffle game are provided. One embodiment comprises a method for a progressive lottery game that establishes an initial amount for a lottery jackpot and a raffle-triggering jackpot amount for a progressive lottery game, performing a first lottery draw for the progressive lottery game, and if there is not a jackpot winner based on the first lottery draw, increasing the lottery jackpot to a new amount. Otherwise, if the new amount exceeds the raffle-triggering jackpot amount, combining a raffle game with the progressive lottery game for a subsequent lottery draw. Alternately, the method includes adding a raffle-style game to a progressive lottery game when a winning jackpot reaches a predetermined raffle-triggering jackpot amount, and awarding at least one raffle prize when a draw for the progressive lottery game produces a winning jackpot.

4 Claims, 11 Drawing Sheets

U.S. PATENT DOCUMENTS

| | | | | |
|---|---|---|---|---|
| 4,191,376 | A | | 3/1980 | Goldman et al. |
| 4,194,296 | A | | 3/1980 | Pagnozzi et al. |
| 4,195,772 | A | | 4/1980 | Nishimura |
| 4,206,920 | A | | 6/1980 | Weatherford et al. |
| 4,241,942 | A | | 12/1980 | Bachman |
| 4,243,216 | A | | 1/1981 | Mazumber |
| 4,273,362 | A | | 6/1981 | Carrier et al. |
| 4,309,452 | A | | 1/1982 | Sachs |
| 4,313,087 | A | | 1/1982 | Weitzen et al. |
| 4,355,300 | A | | 10/1982 | Weber |
| 4,375,666 | A | | 3/1983 | Buck et al. |
| 4,398,708 | A | | 8/1983 | Goldman et al. |
| 4,407,443 | A | | 10/1983 | McCorkle |
| 4,451,759 | A | | 5/1984 | Heynisch |
| 4,455,039 | A | | 6/1984 | Weitzen et al. |
| 4,457,430 | A | | 7/1984 | Darling et al. |
| 4,464,423 | A | | 8/1984 | LaBianca et al. |
| 4,466,614 | A | | 8/1984 | Bachman et al. |
| 4,488,646 | A | | 12/1984 | McCorkle |
| 4,491,319 | A | | 1/1985 | Nelson |
| 4,494,197 | A | | 1/1985 | Troy et al. |
| 4,536,218 | A | | 8/1985 | Ganho |
| 4,544,184 | A | | 10/1985 | Freund et al. |
| 4,579,371 | A | | 4/1986 | Long et al. |
| 4,591,189 | A | | 5/1986 | Holmen et al. |
| 4,634,149 | A | | 1/1987 | Donovan |
| 4,665,502 | A | | 5/1987 | Kreisner |
| 4,669,729 | A | | 6/1987 | Solitt et al. |
| 4,689,742 | A | | 8/1987 | Troy et al. |
| 4,726,608 | A | | 2/1988 | Walton |
| 4,736,109 | A | | 4/1988 | Dvorzsak |
| 4,740,016 | A | | 4/1988 | Konecny et al. |
| 4,760,247 | A | | 7/1988 | Keane et al. |
| 4,763,927 | A | | 8/1988 | Schneider |
| 4,775,155 | A | | 10/1988 | Lees |
| 4,792,667 | A | | 12/1988 | Chen |
| 4,805,907 | A | | 2/1989 | Hagiwara |
| 4,817,951 | A | | 4/1989 | Crouch et al. |
| 4,835,624 | A | | 5/1989 | Black et al. |
| 4,836,546 | A | | 6/1989 | DiRe et al. |
| 4,836,553 | A | | 6/1989 | Suttle et al. |
| 4,837,728 | A | | 6/1989 | Barrie et al. |
| 4,856,787 | A | | 8/1989 | Itkis |
| 4,861,041 | A | | 8/1989 | Jones et al. |
| 4,870,260 | A | | 9/1989 | Niepolomski et al. |
| 4,880,964 | A | | 11/1989 | Donahue |
| 4,888,244 | A | | 12/1989 | Masubuchi et al. |
| 4,922,522 | A | | 5/1990 | Scanlon |
| 4,943,090 | A | | 7/1990 | Fienberg |
| 4,960,611 | A | | 10/1990 | Fujisawa et al. |
| 4,961,578 | A | | 10/1990 | Chateau |
| 4,964,642 | A | | 10/1990 | Kamille |
| 4,996,705 | A | | 2/1991 | Entenmann et al. |
| 4,998,010 | A | | 3/1991 | Chandler et al. |
| 4,998,199 | A | | 3/1991 | Tashiro et al. |
| 5,032,708 | A | | 7/1991 | Comerford et al. |
| 5,037,099 | A | | 8/1991 | Burtch |
| 5,046,737 | A | | 9/1991 | Fienberg |
| 5,074,566 | A | | 12/1991 | Desbiens |
| 5,083,815 | A | | 1/1992 | Scrymgeour et al. |
| 5,092,598 | A | | 3/1992 | Kamille |
| 5,094,458 | A | | 3/1992 | Kamille |
| 5,100,139 | A | | 3/1992 | Di Bella |
| 5,109,153 | A | | 4/1992 | Johnsen et al. |
| 5,112,050 | A | | 5/1992 | Koza et al. |
| 5,116,049 | A | | 5/1992 | Sludikoff et al. |
| 5,118,109 | A | | 6/1992 | Gumina |
| 5,119,295 | A | | 6/1992 | Kapur |
| 5,158,293 | A | * | 10/1992 | Mullins ..... 273/139 |
| 5,165,967 | A | | 11/1992 | Theno et al. |
| 5,186,463 | A | | 2/1993 | Marin et al. |
| 5,189,292 | A | | 2/1993 | Batterman et al. |
| 5,193,815 | A | | 3/1993 | Pollard |
| 5,193,854 | A | | 3/1993 | Borowski, Jr. et al. |
| 5,228,692 | A | | 7/1993 | Carrick et al. |
| 5,232,221 | A | | 8/1993 | Sludikoff et al. |
| 5,234,798 | A | | 8/1993 | Heninger et al. |
| 5,249,801 | A | | 10/1993 | Jarvis |
| 5,259,616 | A | | 11/1993 | Bergmann |
| 5,273,281 | A | | 12/1993 | Lovell |
| 5,276,980 | A | | 1/1994 | Carter et al. |
| 5,282,620 | A | | 2/1994 | Keesee |
| 5,308,992 | A | | 5/1994 | Crane et al. |
| 5,317,135 | A | | 5/1994 | Finocchio |
| 5,326,104 | A | | 7/1994 | Pease et al. |
| 5,332,219 | A | | 7/1994 | Marnell, II et al. |
| 5,342,047 | A | | 8/1994 | Hiedel et al. |
| 5,342,049 | A | | 8/1994 | Wichinsky et al. |
| 5,344,144 | A | | 9/1994 | Canon |
| 5,346,258 | A | | 9/1994 | Behn et al. |
| 5,380,007 | A | | 1/1995 | Travis et al. |
| 5,393,057 | A | | 2/1995 | Marnell, II et al. |
| 5,401,024 | A | | 3/1995 | Simunek |
| 5,403,039 | A | | 4/1995 | Borowski, Jr. et al. |
| 5,407,199 | A | | 4/1995 | Gumina |
| 5,420,406 | A | | 5/1995 | Izawa et al. |
| 5,432,005 | A | | 7/1995 | Tanigami et al. |
| 5,451,052 | A | | 9/1995 | Behm et al. |
| 5,453,602 | A | | 9/1995 | Hanada |
| 5,456,465 | A | | 10/1995 | Durham |
| 5,471,039 | A | | 11/1995 | Irwin, Jr. et al. |
| 5,471,040 | A | | 11/1995 | May |
| 5,475,205 | A | | 12/1995 | Behm et al. |
| 5,486,005 | A | | 1/1996 | Neal |
| 5,513,846 | A | | 5/1996 | Niederlein et al. |
| 5,528,154 | A | | 6/1996 | Leichner et al. |
| 5,536,016 | A | | 7/1996 | Thompson |
| 5,540,442 | A | | 7/1996 | Orselli et al. |
| 5,548,110 | A | | 8/1996 | Storch et al. |
| 5,550,746 | A | | 8/1996 | Jacobs |
| 5,560,610 | A | | 10/1996 | Behm et al. |
| 5,564,700 | A | | 10/1996 | Celona |
| 5,564,977 | A | | 10/1996 | Algie |
| 5,591,956 | A | | 1/1997 | Longacre, Jr. et al. |
| 5,599,046 | A | | 2/1997 | Behm et al. |
| 5,602,381 | A | | 2/1997 | Hoshino et al. |
| 5,621,200 | A | | 4/1997 | Irwin et al. |
| 5,628,684 | A | | 5/1997 | Bouedec |
| 5,630,753 | A | | 5/1997 | Fuchs |
| 5,651,735 | A | | 7/1997 | Baba |
| 5,655,961 | A | | 8/1997 | Acres et al. |
| 5,667,250 | A | | 9/1997 | Behm et al. |
| 5,682,819 | A | | 11/1997 | Beatty |
| 5,690,366 | A | | 11/1997 | Luciano |
| RE35,684 | E | | 12/1997 | Maeng |
| 5,704,647 | A | | 1/1998 | Desbiens |
| 5,722,891 | A | | 3/1998 | Inoue |
| 5,726,898 | A | | 3/1998 | Jacobs |
| 5,732,948 | A | | 3/1998 | Yoseloff |
| 5,741,183 | A | | 4/1998 | Acres et al. |
| 5,743,800 | A | | 4/1998 | Huard et al. |
| 5,752,882 | A | | 5/1998 | Acres et al. |
| 5,756,220 | A | | 5/1998 | Hoshino et al. |
| 5,768,142 | A | | 6/1998 | Jacobs |
| 5,769,458 | A | | 6/1998 | Carides et al. |
| 5,770,533 | A | | 6/1998 | Franchi |
| 5,772,509 | A | | 6/1998 | Weiss |
| 5,772,510 | A | | 6/1998 | Roberts |
| 5,772,511 | A | | 6/1998 | Smeltzer |
| 5,779,840 | A | | 7/1998 | Boris |
| 5,789,459 | A | | 8/1998 | Inagaki et al. |
| 5,791,990 | A | | 8/1998 | Schroeder et al. |
| 5,797,794 | A | | 8/1998 | Angell |
| 5,803,504 | A | | 9/1998 | Deshiens et al. |
| 5,816,920 | A | | 10/1998 | Hanai |
| 5,818,019 | A | | 10/1998 | Irwin, Jr. et al. |
| 5,820,459 | A | | 10/1998 | Acres et al. |
| 5,823,874 | A | | 10/1998 | Adams |
| 5,830,063 | A | | 11/1998 | Byrne |
| 5,830,066 | A | | 11/1998 | Goden et al. |
| 5,830,067 | A | | 11/1998 | Graves et al. |
| 5,833,537 | A | | 11/1998 | Barrie |
| 5,835,576 | A | | 11/1998 | Katz et al. |
| 5,836,086 | A | | 11/1998 | Elder |
| 5,836,817 | A | | 11/1998 | Acres et al. |
| 5,848,932 | A | | 12/1998 | Adams |
| 5,863,075 | A | | 1/1999 | Rich et al. |

| | | | |
|---|---|---|---|
| 5,871,398 | A | 2/1999 | Schneier et al. |
| 5,876,284 | A | 3/1999 | Acres et al. |
| 5,882,261 | A | 3/1999 | Adams |
| 5,883,537 | A | 3/1999 | Luoni et al. |
| 5,885,158 | A | 3/1999 | Torango et al. |
| 5,887,906 | A | 3/1999 | Sultan |
| 5,903,340 | A | 5/1999 | Lawady et al. |
| 5,911,418 | A | 6/1999 | Adams |
| 5,915,588 | A | 6/1999 | Stoken et al. |
| 5,934,671 | A | 8/1999 | Harrison |
| 5,970,143 | A | 10/1999 | Schneier et al. |
| 5,979,894 | A | 11/1999 | Alexoff |
| 5,996,997 | A | 12/1999 | Kamille |
| 5,997,044 | A | 12/1999 | Behm et al. |
| 6,004,207 | A | 12/1999 | Wilson, Jr. et al. |
| 6,004,208 | A | 12/1999 | Takemoto et al. |
| 6,007,162 | A | 12/1999 | Hinz et al. |
| 6,012,982 | A | 1/2000 | Piechowiak et al. |
| 6,014,819 | A | 1/2000 | Elder |
| 6,017,032 | A | 1/2000 | Grippo et al. |
| 6,024,641 | A | 2/2000 | Sarno |
| 6,033,307 | A | 3/2000 | Vancura |
| 6,053,405 | A | 4/2000 | Irwin, Jr. et al. |
| 6,077,162 | A | 6/2000 | Weiss |
| 6,080,062 | A | 6/2000 | Olson |
| 6,086,477 | A | 7/2000 | Walker et al. |
| 6,089,978 | A | 7/2000 | Adams |
| 6,099,407 | A | 8/2000 | Parker, Jr. et al. |
| 6,102,400 | A | 8/2000 | Scott et al. |
| 6,107,913 | A | 8/2000 | Gatto et al. |
| 6,119,364 | A | 9/2000 | Elder |
| 6,125,368 | A | 9/2000 | Bridge et al. |
| 6,142,872 | A | 11/2000 | Walker et al. |
| 6,146,272 | A | 11/2000 | Walker et al. |
| 6,149,521 | A | 11/2000 | Sanduski |
| 6,155,491 | A | 12/2000 | Dueker et al. |
| 6,168,521 | B1 | 1/2001 | Luciano et al. |
| 6,168,522 | B1 | 1/2001 | Walker et al. |
| 6,179,710 | B1 | 1/2001 | Sawyer et al. |
| 6,203,430 | B1 | 3/2001 | Walker et al. |
| 6,206,373 | B1 | 3/2001 | Garrod |
| 6,210,275 | B1 | 4/2001 | Olsen |
| 6,210,276 | B1 | 4/2001 | Mullins |
| 6,217,448 | B1 | 4/2001 | Olsen |
| 6,220,596 | B1 | 4/2001 | Horan |
| 6,220,961 | B1 | 4/2001 | Keane et al. |
| 6,224,055 | B1 | 5/2001 | Walker et al. |
| 6,227,969 | B1 | 5/2001 | Yoseloff |
| 6,238,288 | B1 | 5/2001 | Walker et al. |
| 6,309,300 | B1 | 10/2001 | Glavich |
| 6,312,334 | B1 | 11/2001 | Yoseloff |
| 6,315,291 | B1 | 11/2001 | Moody |
| 6,330,976 | B1 | 12/2001 | Dymetman et al. |
| 6,331,143 | B1 | 12/2001 | Yoseloff |
| 6,334,814 | B1 | 1/2002 | Adams |
| 6,340,158 | B2 | 1/2002 | Pierce et al. |
| 6,368,213 | B1 | 4/2002 | McNabola |
| 6,375,568 | B1 | 4/2002 | Roffman et al. |
| 6,379,742 | B1 | 4/2002 | Behm et al. |
| 6,394,899 | B1 | 5/2002 | Walker et al. |
| 6,398,214 | B1 | 6/2002 | Moteki et al. |
| 6,398,643 | B1 | 6/2002 | Knowles et al. |
| 6,398,644 | B1 | 6/2002 | Perrie et al. |
| 6,398,645 | B1 | 6/2002 | Yoseloff |
| 6,416,408 | B2 | 7/2002 | Tracy et al. |
| 6,419,579 | B1 | 7/2002 | Bennett |
| 6,435,408 | B1 | 8/2002 | Irwin, Jr. et al. |
| 6,435,500 | B2 | 8/2002 | Gumina |
| 6,478,677 | B1 | 11/2002 | Moody |
| 6,491,215 | B1 | 12/2002 | Irwin, Jr. et al. |
| 6,497,408 | B1 | 12/2002 | Walker et al. |
| 6,552,290 | B1 | 4/2003 | Lawandy |
| 6,588,747 | B1 | 7/2003 | Seelig |
| 6,599,186 | B1 | 7/2003 | Walker et al. |
| 6,601,772 | B1 | 8/2003 | Rubin et al. |
| 6,637,747 | B1 | 10/2003 | Garrod |
| 6,648,735 | B2 | 11/2003 | Miyashita et al. |
| 6,648,753 | B1 | 11/2003 | Tracy et al. |
| 6,648,755 | B1 | 11/2003 | Luciano et al. |
| 6,676,126 | B1 | 1/2004 | Walker et al. |
| 6,692,354 | B2 | 2/2004 | Tracy et al. |
| 6,702,047 | B2 | 3/2004 | Huber |
| 6,773,345 | B2 | 8/2004 | Walker et al. |
| 6,776,337 | B2 | 8/2004 | Irwin, Jr. et al. |
| 6,786,824 | B2 | 9/2004 | Cannon |
| 6,823,874 | B2 | 11/2004 | Lexcen |
| 6,875,105 | B1 | 4/2005 | Behm et al. |
| 6,929,186 | B2 | 8/2005 | Lapstun |
| 7,213,811 | B2 * | 5/2007 | Bozeman ..... 273/139 |
| 2001/0027130 | A1 | 10/2001 | Namba et al. |
| 2001/0030978 | A1 | 10/2001 | Holloway et al. |
| 2001/0034262 | A1 | 10/2001 | Banyai |
| 2001/0040345 | A1 | 11/2001 | Au-Yeung |
| 2002/0022511 | A1 | 2/2002 | Eklund et al. |
| 2002/0084335 | A1 | 7/2002 | Ericson |
| 2002/0169019 | A1 | 11/2002 | Walker et al. |
| 2002/0171201 | A1 | 11/2002 | Au-Yeung |
| 2002/0187825 | A1 | 12/2002 | Tracy et al. |
| 2003/0045339 | A1 | 3/2003 | Ghela |
| 2003/0050109 | A1 | 3/2003 | Caro et al. |
| 2003/0060264 | A1 * | 3/2003 | Chilton et al. ..... 463/20 |
| 2003/0087691 | A1 | 5/2003 | Kiely et al. |
| 2003/0104853 | A1 * | 6/2003 | Tessmer et al. ..... 463/16 |
| 2003/0104857 | A1 | 6/2003 | Jenkins |
| 2003/0114210 | A1 | 6/2003 | Meyer et al. |
| 2003/0122303 | A1 | 7/2003 | Moore |
| 2003/0178771 | A1 | 9/2003 | Banyai |
| 2003/0227134 | A1 | 12/2003 | Khal |
| 2004/0076310 | A1 | 4/2004 | Hersch et al. |
| 2004/0082377 | A1 * | 4/2004 | Seelig et al. ..... 463/17 |
| 2004/0173965 | A1 | 9/2004 | Stanek |
| 2004/0178582 | A1 | 9/2004 | Garrod |
| 2004/0185931 | A1 | 9/2004 | Lowell et al. |
| 2004/0204222 | A1 | 10/2004 | Roberts |
| 2004/0209691 | A1 * | 10/2004 | Roush ..... 463/40 |
| 2004/0259631 | A1 | 12/2004 | Katz et al. |
| 2004/0266514 | A1 | 12/2004 | Penrice |
| 2006/0009283 | A1 * | 1/2006 | Englman et al. ..... 463/29 |
| 2006/0076734 | A1 * | 4/2006 | Bozeman ..... 273/269 |
| 2006/0116201 | A1 * | 6/2006 | Gauselmann ..... 463/26 |
| 2006/0119034 | A1 * | 6/2006 | Bozeman ..... 273/138.1 |
| 2009/0131140 | A1 * | 5/2009 | Szrek et al. ..... 463/17 |
| 2010/0041464 | A1 * | 2/2010 | Arezina et al. ..... 463/22 |

FOREIGN PATENT DOCUMENTS

| | | | |
|---|---|---|---|
| AU | B-21070/92 | | 7/1993 |
| AU | A-50327/96 | | 2/1997 |
| AU | B-52499/96 | | 2/1997 |
| AU | 199716432 | B2 | 9/1997 |
| AU | A-45403/97 | | 4/1998 |
| AU | A-63553/98 | | 10/1998 |
| DE | 2938307 | C2 | 4/1981 |
| DE | 3035898 | A1 | 4/1982 |
| DE | 3035947 | A1 | 5/1982 |
| DE | 2938307 | C3 | 6/1982 |
| DE | 29803107 | U1 | 8/1988 |
| DE | 3822636 | A1 | 1/1990 |
| DE | 2938307 | C3 | 8/1990 |
| DE | 3822636 | A1 | 1/1992 |
| DE | 3415114 | A1 | 10/1995 |
| DE | 19646956 | C1 | 5/1998 |
| DE | 19706286 | A1 | 5/1998 |
| DE | 29816453 | U1 | 4/1999 |
| DE | 19751746 | A1 | 5/1999 |
| EP | 0122902 | B1 | 4/1984 |
| EP | 0333934 | A1 | 9/1989 |
| EP | 0458623 | | 11/1991 |
| EP | 0798676 | A1 | 10/1997 |
| EP | 0799649 | A1 | 10/1997 |
| EP | 0149712 | A2 | 7/1998 |
| EP | 0874337 | A1 | 10/1998 |
| EP | 0896304 | A2 | 2/1999 |
| EP | 0914875 | A2 | 5/1999 |
| EP | 0914875 | A3 | 5/1999 |
| EP | 0919965 | A2 | 6/1999 |
| EP | 0983801 | A2 | 3/2000 |
| EP | 0983801 | A3 | 3/2001 |
| EP | 1149712 | A1 | 10/2001 |

| | | | |
|---|---|---|---|
| ES | 529535 | | 6/1983 |
| ES | 529536 | | 6/1983 |
| ES | 2006400 | | 4/1989 |
| ES | 2006401 | | 4/1989 |
| GB | 642892 | A | 9/1950 |
| GB | 2075918 | A | 11/1981 |
| GB | 2222712 | B | 3/1990 |
| GB | 2230373 | A | 10/1990 |
| GB | 2295775 | A | 12/1996 |
| GB | 3328311 | | 2/1999 |
| GB | 23282311 | A | 2/1999 |
| JP | 02235744 | | 9/1990 |
| JP | 04132672 | | 5/1992 |
| WO | WO85/02250 | A1 | 5/1985 |
| WO | WO91/17529 | | 11/1991 |
| WO | WO 98/03910 | | 1/1998 |
| WO | WO 98/40138 | | 9/1998 |
| WO | WO 99/09364 | A1 | 2/1999 |
| WO | WO 99/26204 | | 5/1999 |
| WO | WO 99/39312 | | 8/1999 |
| WO | WO00/00256 | | 1/2000 |
| WO | WO00/78418 | A1 | 12/2000 |
| WO | WO 01/74460 | A2 | 11/2001 |
| WO | WO01/93966 | A1 | 12/2001 |
| WO | WO02/056266 | A1 | 7/2002 |
| WO | WO 02/094400 | | 11/2002 |

OTHER PUBLICATIONS

'Beginner's Guide-How to Bet', (www.plimico.com/How+to+wager/beginnersguide/), (Internet Article), 3 Pgs.
Chip Brown, 'Austin American-Statesman', (Article), May 28, 1998, 2 Pgs., Texas.
John C. Hallyburton, Jr., 'Frequently Asked Questions About Keno', (Internet Article),1995, 1998, 10 Pgs., (http://conielco.com/faq/keno.html).
'Horse betting Tutorial-Types of Bets' (www.homepokergames.com/horsebettingtutorial.php), (Internet Article), 2 Pgs.
Judith Gaines, 'Pool Party Betting Business Booming Throughout Area Workplaces', (Internet Article), Mar. 19, 1994, 2 Pgs., Issue 07431791, Boston Globe, Boston, MA.
'Maryland Launches Let It Ride', (Internet Article), Circa 2001,1 Pg.
'Notice of Final Rulemaking', (Internet Article) Mar. 24, 2000, 10 Pgs., vol. 6, Issue #13, Arizona Administrative Register, Arizona.
'How to Play Megabucks', (Internet Article), Mar. 9, 2001, 2 Pgs., Oregon Lottery Megabucks,(http://www.oregonlottery.org/mega/m_howto.htm).
'How To Play Megabucks', (Internet Article), May 8, 2001, 2 Pgs., Oregon Lottery Megabucks, (http://www.oregonlottery.org/mega/m_howto.htm).
'Oregon Lottery', (Internet Article), Apr. 30, 2004, 9 Pgs., Oregon Lottery Web Center, (http://www.oregonlottery.org/general/g_hist.shtml).
'Powerball Odd & Prizes', 'How to Play Powerball', (Internet Article),Dec. 2002, 2 Pgs., (www.powerball.com/pbhowtoplay.shtm).
'Powerball Prizes and Odds', (Internet Article), 2 Pgs., http://www.powerball.com/pbprizesNOdds.shtm.
'Learn To Play the Races' (Internet Article), 15 Pgs., Racing Daily Form (www.drf.com).
Mike Parker, 'The History of Horse Racing' (Internet Article),1996, 1997,1998, 5 Pgs., http://www.mrmike.com/explore/hrhist.htm.
EP Search Report, Jun. 1, 2010.
International Search Report and Written Opinion Oct. 17, 2007.

* cited by examiner

200

| | ODDS | PRIZE |
|---|---|---|
| PICK 1 | 1 in 10 | $5 |
| PICK 2 | 1 in 100 | $50 |
| PICK 3 | 1 in 1,000 | $500 |
| PICK4 | 1 in 10,000 | $5,000 |
| Overall Odds | 1 in 9.1 | |

Raffle

- For each draw, the odds of having a raffle are 1 in 10
- 10% of sales per drawing allocated to the raffle are accumulated between the raffle's drawings
- Each raffle will produce a unique winner

500

| | |
|---|---|
| Pick 1 | 3 |
| Pick 2 | 1 7 |
| Pick 3 | 3 5 0 |
| Pick 4 | 2 1 0 2 |

502

- The player wins $5 for matching the Pick 1 number and $50 for matching the Pick 2 number

- There will be no raffle for that drawing because the Pick 2 numbers 1 and 7 are different. 10% of sales allocated to the raffle will rollover to the next drawing.

*FIG. 5*

800

| | |
|---|---|
| Pick 1 | 3 |
| Pick 2 | 1 1 |
| Pick 3 | 3 5 0 |
| Pick 4 | 7 8 5 9 |

802

Winning raffle number: 000 011 799 804

- The player wins $500 for matching the Pick 3 number

- The player also wins the raffle. The raffle's drawing was held because the predetermined triggering event occurred – the Pick 2 numbers were identical (1-1)

*FIG. 8*

1000

Starting Jackpot: $5,000,000
Raffle-Trigger Threshold: $10,000,000

| MATCHES | ODDS | PRIZE |
|---|---|---|
| 6 | 1 in 28,989,675.0 | Jackpot |
| 5 | 1 in 98,604.3 | $5,000 |
| 4 | 1 in 1,643.4 | $200 |
| 3 | 1 in 78.7 | $10 |
| 2 | 1 in 9.1 | $2 |

Overall 1 in 8.1

*FIG. 10*

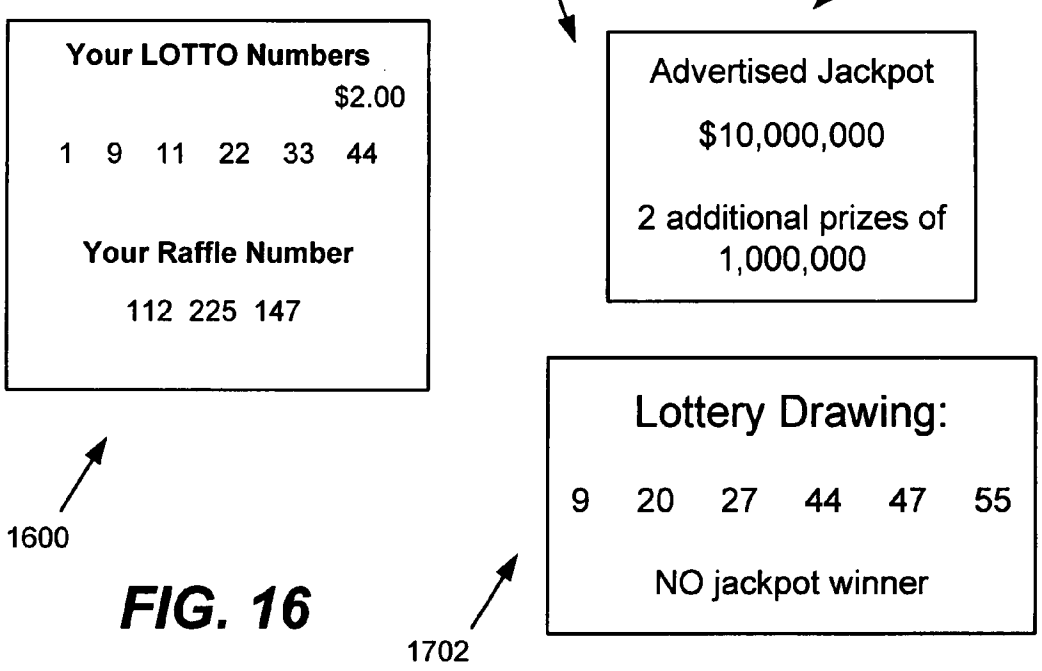
FIG. 16
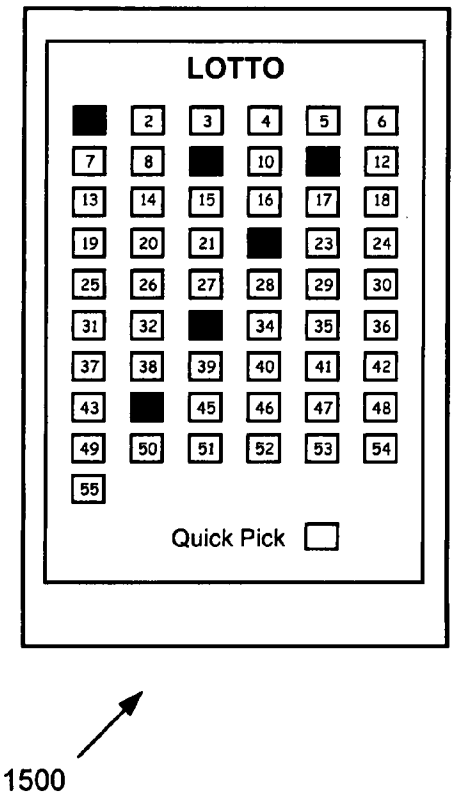
FIG. 15
Player matches 4 numbers and wins $200
No jackpot winner, so 2 additional prizes of $1,000,000 are not awarded
FIG. 17

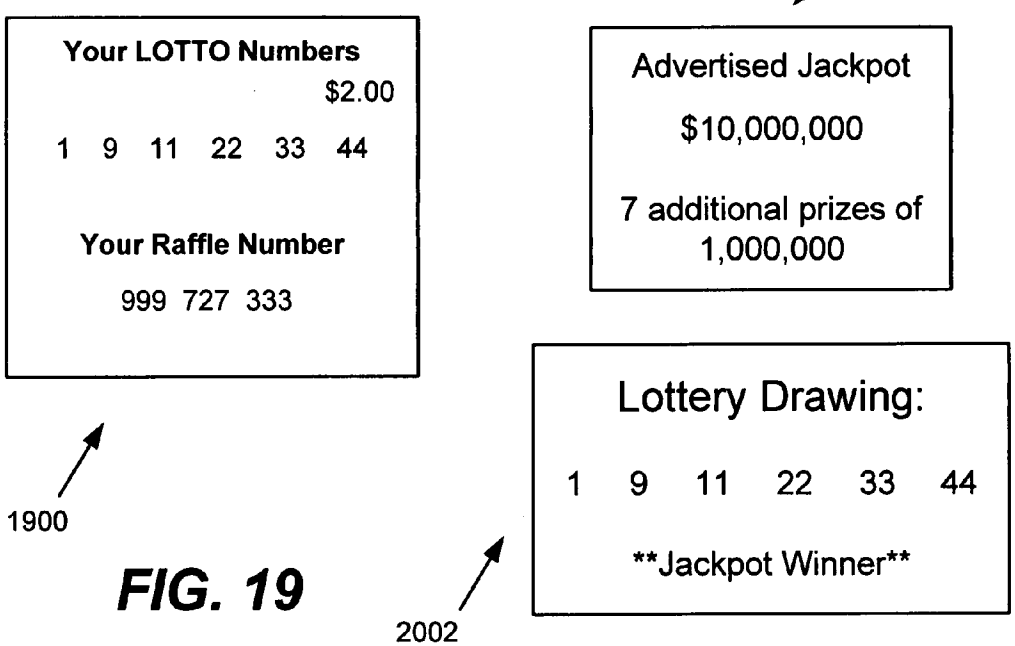
FIG. 19
$10,000,000 jackpot is won and, therefore, 7 additional prizes of $1,000,000 are awarded
Seven winning raffle numbers are chosen.
FIG. 20
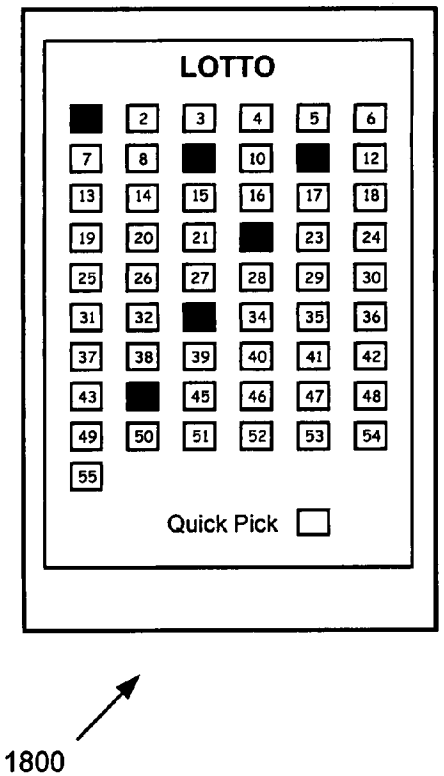
FIG. 18

COMBINATION LOTTERY AND RAFFLE GAME

CROSS-REFERENCE TO RELATED APPLICATION

This application claims the benefit of the priority of U.S. Provisional Patent Application Ser. No. 60/651,317, filed Feb. 9, 2005, and entitled "Randomly Triggered Raffle-Style Game Method", which is hereby incorporated herein by this reference in its entirety.

BACKGROUND OF THE INVENTION

Many governments, as well as gaming organizations, sponsor wagering games known as lotteries for fund raising purposes. A typical lottery game entails players selecting permutations or combinations of numbers. This is followed by a "draw," in which the lottery randomly selects a combination or permutation of numbered balls. Prizes are awarded based on the number of matches between a player's selection and the drawn numbers.

Lotteries have become an important source of income to governments as they shoulder much of the financial burden for education and other programs. However, as governments have grown more dependent on lotteries it has become a challenge to encourage participation in lotteries and, thereby increase sales.

Thus, there is a need for lottery games that combine the attraction of a large lottery-style prize, the excitement caused by the anticipation of the realization of a triggering event, and the well-liked structure of a raffle for the purposes of keeping current lottery game players active in the lottery, as well as enticing new players to participate in lottery games.

SUMMARY OF THE INVENTION

Various embodiments of a combination lottery/raffle game are provided. One embodiment comprises a method for a progressive lottery game. One such method comprises: establishing an initial amount for a lottery jackpot and a raffle-triggering jackpot amount for a progressive lottery game; performing a first lottery draw for the progressive lottery game; if there is not a jackpot winner based on the first lottery draw, increasing the lottery jackpot to a new amount; if the new amount exceeds the raffle-triggering jackpot amount, combining a raffle game with the progressive lottery game for a subsequent lottery draw. Another such method comprises: adding a raffle-style game to a progressive lottery game when a winning jackpot reaches a predetermined raffle-triggering jackpot amount; and awarding at least one raffle prize when a draw for the progressive lottery game produces a winning jackpot.

Another embodiment comprises a method for a lottery game. One such method comprises: receiving a lottery entry for at least one player; generating a unique raffle number associated with the lottery entry; performing a lottery draw for a lottery-style game; determining whether a triggering event occurs; and if the triggering event occurs, performing a raffle draw.

Yet another embodiment comprises a method for implementing a lottery-style game comprising combining a raffle game with the lottery-style game if a triggering event occurs.

BRIEF DESCRIPTION OF THE DRAWINGS

FIG. 5 is an illustration of a game drawing and associated results for the playslip and ticket of FIGS. 3 & 4.

FIG. 8 is an illustration of a game drawing and associated results for the playslip and ticket of FIGS. 6 & 7.

FIG. 10 is an illustration of prize table for another embodiment of a combination lottery/raffle game.

FIG. 15 is an illustration of a game playslip for the fifth drawing of the combination lottery/raffle game.

FIG. 16 is an illustration of a game ticket for the game playslip of FIG. 15.

FIG. 17 is an illustration of a fifth game drawing and associated results for the playslip and ticket of FIGS. 15 & 16.

FIG. 18 is an illustration of a game playslip for the sixth drawing of the combination lottery/raffle game.

FIG. 19 is an illustration of a game ticket for the game playslip of FIG. 18.

FIG. 20 is an illustration of a sixth game drawing and associated results for the playslip and ticket of FIGS. 18 and 19.

DETAILED DESCRIPTION OF THE INVENTION

Figures 1, 2:
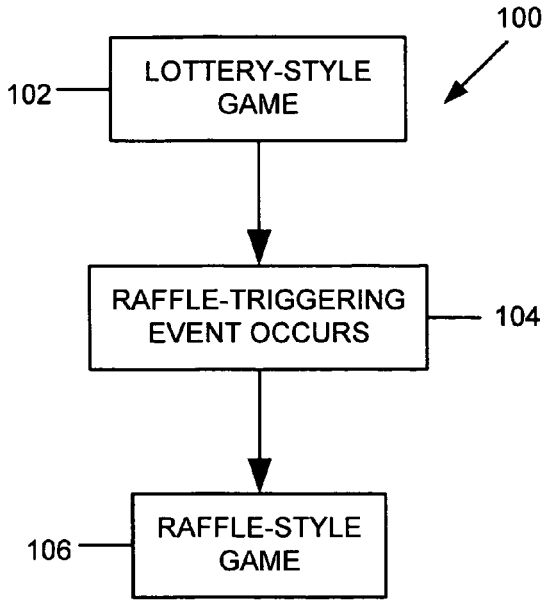
FIG. 1 is a block diagram illustrating an embodiment of a method for a combination lottery/raffle game.
FIG. 2 is an illustration of a prize table for an embodiment of a combination lottery/raffle game.

Various embodiments of a combination lottery/raffle game and associated methods are described below with respect to FIGS. 1-21. FIG. 1 illustrates one embodiment of a CLRG 100. In general, as the name suggests, combination lottery/raffle game 100 comprises a combination of a lottery-style game 102 and a raffle-style game 106. Raffle-style game 106 is initiated and/or played when a predetermined raffle-triggering event occurs (block 104—FIG. 1). Lottery-style game 102 comprises any desirable lotto or lottery game, such as those in which players select a group of numbers from a set, and are awarded prizes based on how many match a randomly-drawn result. In a typical lottery-style game, for example, a player may select (or a computer may randomly select for the player) six numbers from a set of 49. At a predetermined time, six numbers are randomly drawn. A player wins a major prize if all six of their numbers match those chosen in the random drawing. The player may also win smaller prizes for matching less than all of the drawn numbers. As a further example, some well-known variants of lottery-style games include government-run games such as "Powerball", "The Big Game", and "Lottery Extra" (United Kingdom). Raffle-style game 106 comprises a passive game in which each entry is assigned a unique number, and the raffle drawing involves a selection of one or more of the unique numbers as "winners".

It should be appreciated that raffle-style game 106 may be combined, added, or otherwise integrated with lottery-style game 102 in numerous ways based on the occurrence of the raffle-triggering event. The raffle-triggering event defines when the raffle portion of the game is to be initiated and/or played.

In one implementation of combination lottery/raffle game 100, at the time of purchase, the player receives a ticket containing the player-selected indicia for lottery-style game 102, as well as a set of indicia selected by the lottery for raffle-style game 106. The player-selected indicia portion of the lottery game may be played in conventional ways based on the rules of the particular lottery game. The raffle-style portion of the game includes the selection and printing of indicia on the respective game player tickets by the lottery. The raffle game indicia are chosen by the lottery from a set of indicia determined by the lottery to ensure that each ticket will receive a unique set of indicia. When the drawing for the base lottery game is performed, the raffle drawing will also take place if the triggering event has occurred. The triggering event may be a predetermined random event selected by the lottery. The predetermined random event may be specified in advance by the lottery so that the game players will know at the time of the lottery drawing whether there will be an additional raffle drawing or not. The random event used by the lottery to trigger the raffle may or may not be related to the drawing of the lottery game, as desired by the lottery.

When a raffle is triggered, the lottery will draw, depending on the prize structure of the raffle, one or more set of indicia from the set of unique indicia distributed to the players at the time of their game entry or ticket purchase. The player wins a raffle prize by matching the lottery-selected unique indicia with the lottery-generated indicia printed on their ticket at the time of purchase. If the random event chosen by the lottery to trigger the raffle does not occur, the amount of money put aside by the lottery for the raffle portion of the game may rollover to the next drawing in a separate prize pool or pot.

Various-additional embodiments of a combination lottery/raffle game will be described with reference to FIGS. 2-8. In this embodiment, an add-on raffle game is offered in concert with a $4 numbers-style lottery game (e.g., a "Bundled Pick" game). The Bundled Pick game comprises a package of games which includes a Pick 4 game, a Pick 3 game, a Pick 2 game, and a Pick 1 game, respectively, combined with a randomly-triggered raffle game. The Pick 4 and Pick 3 games, respectively, are 4-digit and 3-digit numbers games of the type known to those skilled in the art. Similarly, the Pick 2 and Pick 1 games, respectively, are each a 2-digit and a 1-digit numbers game version of the Pick 4 and Pick 3 games, and are also well known to those skilled in the art.

FIG. 2 illustrates a prize table 200 for such an embodiment of a combination lottery/raffle game. The Bundled Pick game comprises a player selecting indicia from a set of indicia {0,1,2,3,4,5,6,7,8,9} for each of the 10 digits necessary to provide a complete selection for the 4 numbers games, and as known, the player may request that the lottery system select the necessary indicia for them. The remaining description assumes, for the purposes of simplicity, that the player has selected the game indicia for the base lottery game(s).

Figure 3:
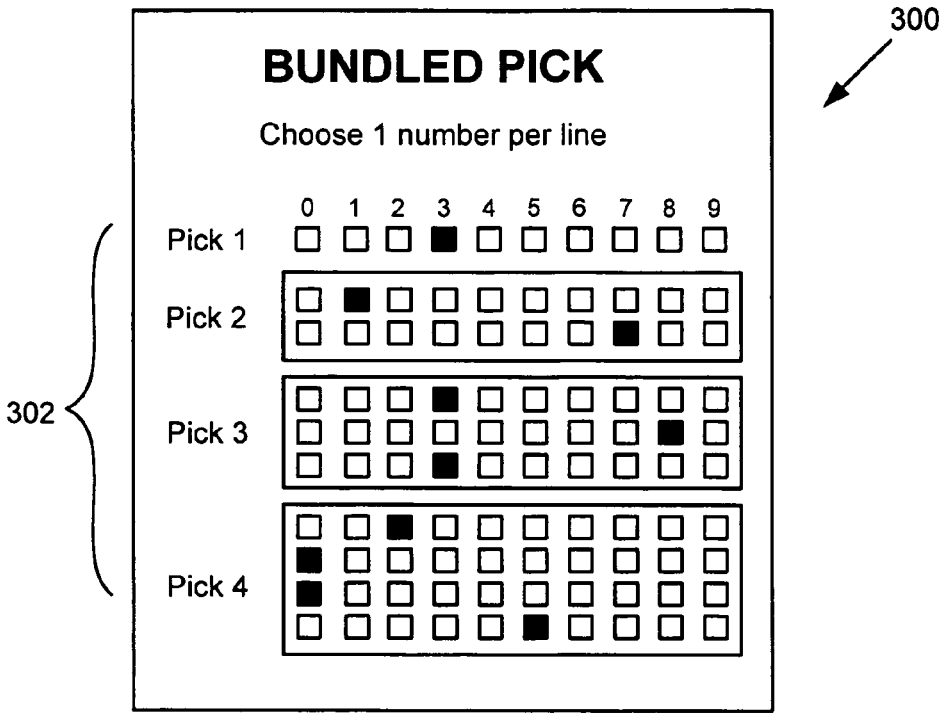
FIG. 3 is an illustration of a game playslip for an embodiment of a combination lottery/raffle game.

At the time of purchase, the players submit their selections along with a $4 wager to a lottery system, typically through an authorized lottery retailer operating a lottery terminal, or through a self-serve kiosk or other automated means. FIG. 3 illustrates an example of a game playslip 300 for the Bundled Pick lottery-style game. As illustrated in FIG. 3, the player selects four game indicia 302 (i.e., picks). In this example, Pick 1 involves selecting one number in the set of indicia {0,1,2,3,4,5,6,7,8,9}, Pick 2 involves selecting two numbers, Pick 3 involves selecting three numbers, and Pick 4 involves selecting four numbers.

Figure 4:
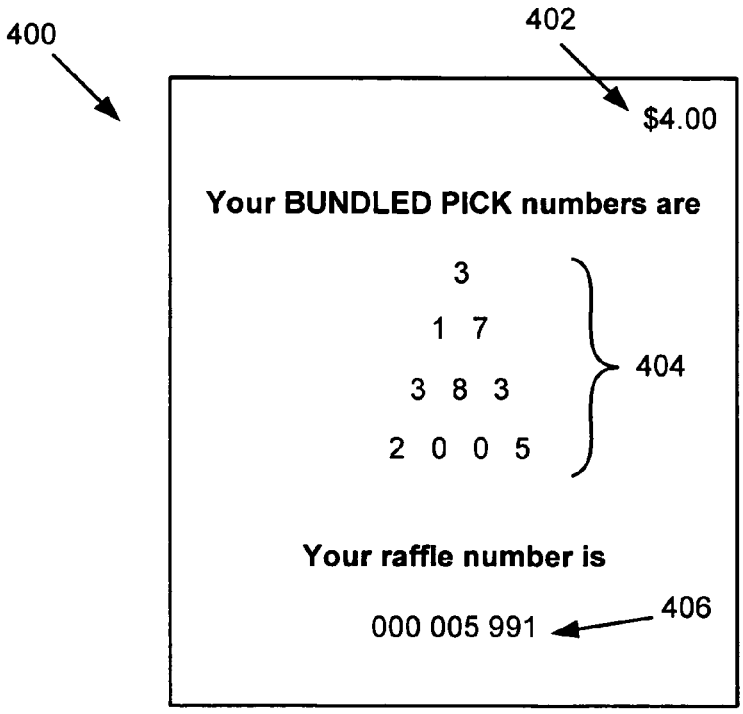
FIG. 4 is an illustration of a game ticket for the playslip of FIG. 3.

FIG. 4 illustrates a lottery game ticket 400 corresponding to playslip 300. Game ticket 400 is provided by the lottery retailer or other entity, system, or device. Game ticket 400 identifies the player's wager 402 ($4 in this case), and also includes the player's selections 404 and the lottery-generated raffle number 406. The set of indicia selected by the lottery is preferably unique for each player's ticket and provides an entry for the raffle portion of the game that will be used by the player to match the raffle numbers, if such a drawing is held in the first instance based on the occurrence of the triggering event.

In this example, the triggering event is defined as the occurrence of the Pick 2 indicia being identical. In other words, a raffle will be held if the indicia selected by the lottery in the drawing of the Pick 2 game are identical. As mentioned above, however, it should be appreciated than any other trigger event selected by the lottery may be used, as desired and as may be used to generate interest and excitement in the game. By making the trigger event the Pick 2 numbers being identical, it is anticipated that a drawing for the raffle would be held, on average, once in every ten drawings. When there is no drawing for the raffle, the amount accumulated for the raffle prize, for example 10% of sales in this exemplary embodiment, or any other desired amount, will rollover and be added to the amount accumulated for the raffle game prize at the next raffle drawing, whenever that first occurs. The event used by the lottery to trigger the raffle game may be specified in advance by the lottery, and will in all likelihood be chosen by the lottery to meet its game's sales objectives.

Referring to game playslip 300 of FIG. 3, the player has made the following selections: 3 for Pick 1; 1-7 for Pick 2; 3-8-3 for Pick 3; and 2-0-0-5 for Pick 4. The player receives game ticket 400 showing selections 404 and a unique lottery-selected raffle indicia 406 (in this case, 000-005-991). FIG. 5 illustrates the results of the lottery drawing: 3 for Pick 1; 1-7 for Pick 2; 3-5-0 for Pick 3; and 2-1-0-2 for Pick 4. Based on prize table 200 (FIG. 2), the player wins $5 for matching the Pick 1 number and $50 for matching the Pick 2 number. A raffle drawing is not held, however, because the predefined triggering event has not occurred—the lottery drawing for the Pick 2 is two different numbers 1-7 (not identical numbers). The player's total winnings are $5+$50=$55. In this example, the 10% of sales used to fund the raffle game prize will rollover to the next Bundled Pick lottery game drawing.

Figure 6:
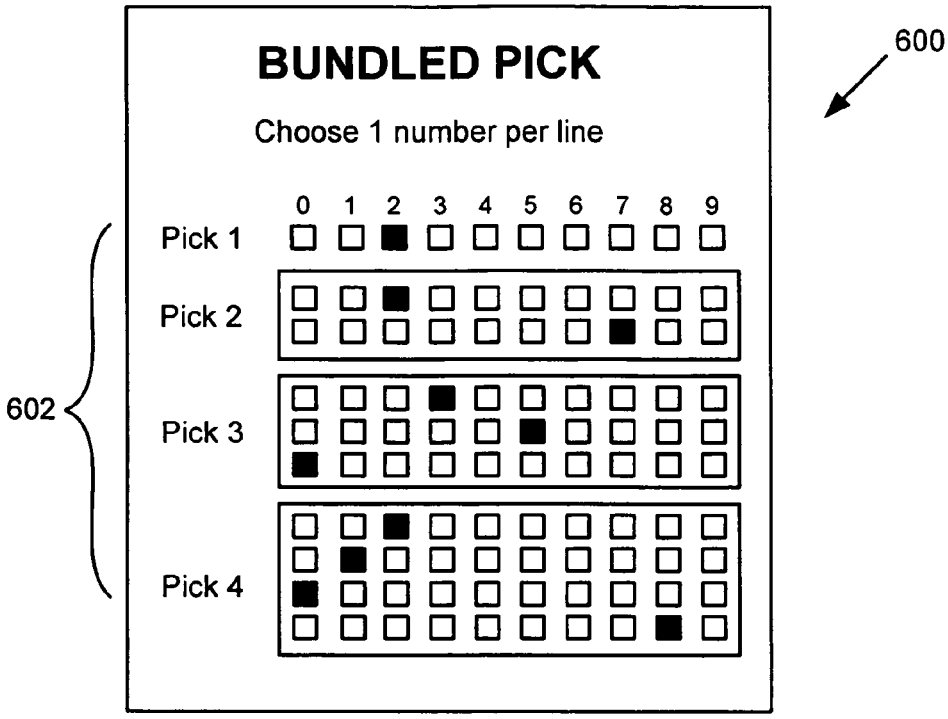
FIG. 6 is an illustration of another game playslip for a combination lottery/raffle game.
Figure 7:
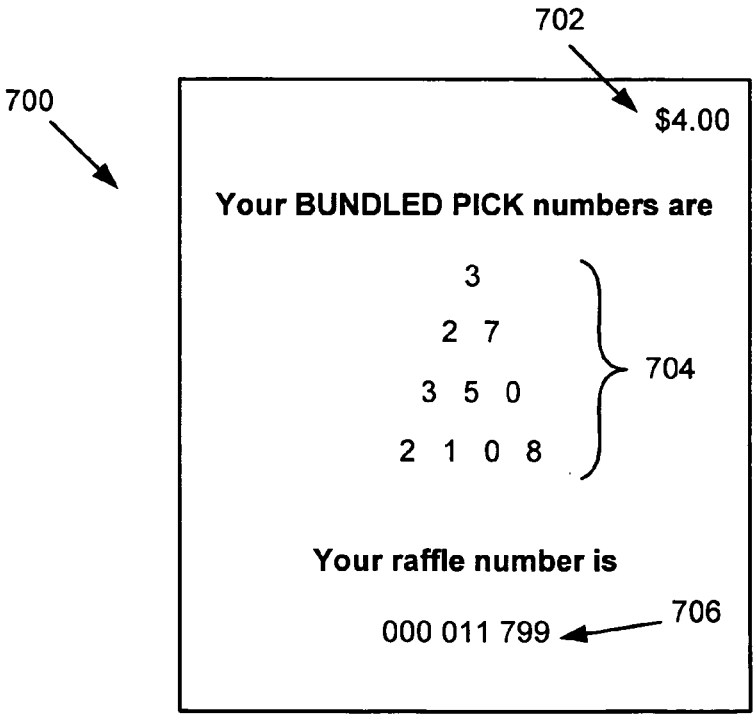
FIG. 7 is an illustration of a game ticket for the playslip of FIG. 6.

FIGS. 6-8 illustrate another game playslip 600 and a corresponding game ticket 700. As illustrated in FIG. 6, in this example, the player has made the following selections: 2 for Pick 1; 2-7 for Pick 2; 3-5-0 for Pick 3; and 2-1-0-8 for the Pick 4 game. The player receives game ticket 700 illustrated in FIG. 7, which lists both the player's number selections 704 and a unique lottery-selected raffle indicia 706 printed on the ticket. Referring to FIG. 8, the lottery drawing is as follows: 3 for the Pick 1 game; 1-1 for the Pick 2 game; 3-5-0 for the Pick 3 game; and 7-8-5-9 for the Pick 4 game.

Based on prize table 200 (FIG. 2), the player wins $500 for matching the Pick 3 number. However, because the lottery drawing for the Pick 2 game is two identical numbers 1-1, which in this instance was the predetermined triggering event, a raffle drawing is held. As illustrated in FIG. 8, the winning raffle number in this example is 000-011-799, which matches the game player's raffle number 706 (FIG. 7) selected by the lottery at the time of ticket purchase. Therefore, the player's total winnings are $500 plus the amount of prize monies accumulated by the lottery in its raffle game prize pool.

Figure 9:
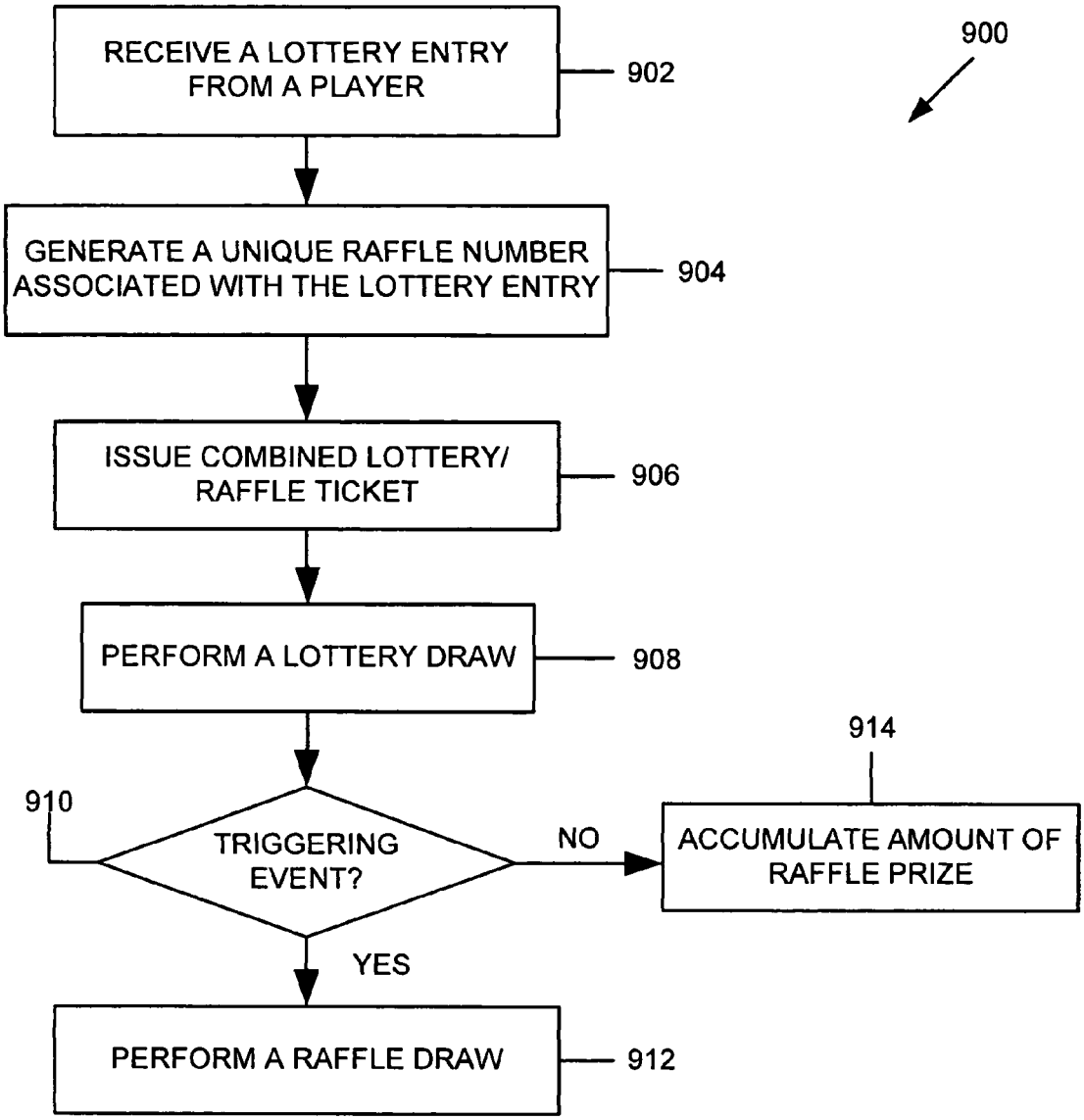
FIG. 9 is a flowchart illustrating the general framework and/or operation of a method for an embodiment of a combination lottery/raffle game.
Figure 11:
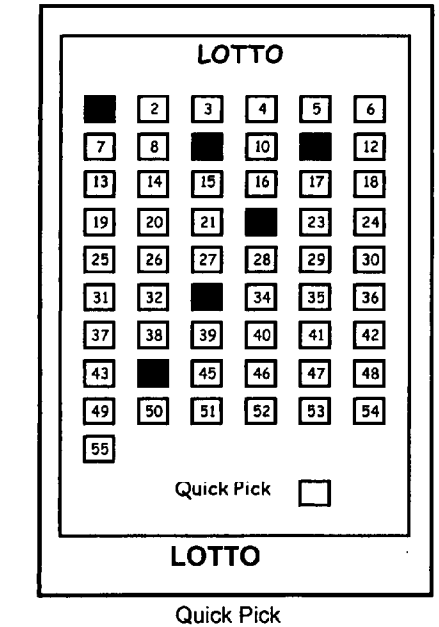
FIG. 11 is an illustration of a game playslip for the first drawing of the combination lottery/raffle game of FIG. 10.

Another embodiment of a combination lottery/raffle game is illustrated in the flowchart of FIG. 9. In this embodiment, the combination lottery/raffle game is described from the perspective of a lottery provider. At block 902, a lottery entry is received from a player. At block 904, a unique raffle number associated with the lottery entry is generated by the lottery provider, or an affiliated entity, computer system, etc. At block 906, a combined lottery/raffle ticket is issued, which includes the player-selected indicia for the base lottery-style game and the unique raffle number for the raffle-style game. At block 908, a lottery draw is performed. As illustrated at decision block 910, if the raffle-triggering event has occurred, a raffle draw will also be performed (block 912). If the triggering even has not occurred, at block 914, the amount of the raffle prizes may be accumulated.

As mentioned above, the features of a combination lottery/raffle game may be implemented with various type of lottery and/or raffle games. In one embodiment, the lottery-style game employs a progressive jackpot (i.e., when a lottery drawing does not produce a jackpot winner, the amount of money accumulated in the jackpot will rollover to the next lottery drawing). FIGS. 10-21 illustrate an embodiment of a combination lottery/raffle game which employs a Pick 6 progressive lottery-style game. As shown below in more detail, in the Pick 6 game, players make six selections from the game indicia (e.g., select six numbers between 1 and 55). In this embodiment, the raffle-style game is not initiated until the progressive jackpot reaches a predetermined threshold. In other words, the raffle feature "kicks-in" only when the jackpot reaches, after some rollovers, the predetermined threshold. The predetermined threshold may be any amount. In certain embodiments, once the jackpot reaches the predetermined threshold (and the raffle feature is triggered), the jackpot amount will hold until somebody wins it. When the raffle feature "kicks-in" and is added to the lottery-style game, new money that would usually go into the jackpot fund will go into a separate pool. The separate pool will be used to fund individual and additional lots of a predetermined size for the raffle prizes. For example, when the raffle feature is triggered, the separate pool will support an initial allotment of one or more raffle prizes. The separate pool is also used to fund additional raffle prizes (or more valuable raffle prizes) for subsequent lottery drawings, until a jackpot winner is produced and the raffle prizes are awarded. In this regard, after the raffle feature is triggered, a unique raffle number (valid only for the drawing for which the play has been purchased) will be generated and printed on the game ticket. The raffle, however, is held only when the lottery jackpot is won. The winning raffle numbers will determine who has won the raffle prizes.

Figure 12:
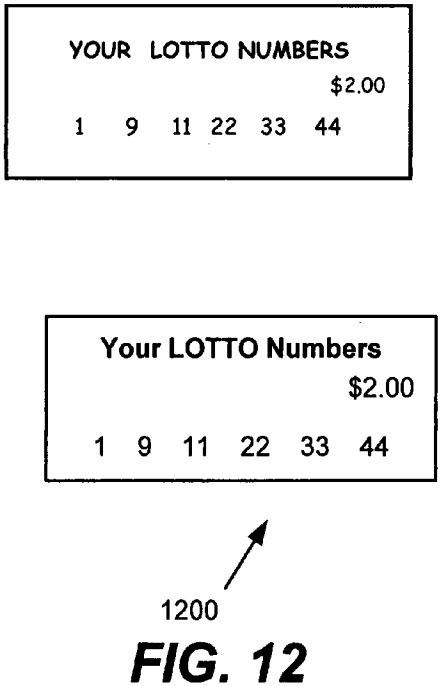
FIG. 12 is an illustration of a game ticket for the game playslip of FIG. 11.

FIG. 10 illustrates a prize table 1000 for the Pick 6 progressive lottery game, which illustrates the prizes for matching 2, 3, 4, 5, and 6 selections. As illustrated in FIG. 10, in this example, the initial amount for the progressive jackpot is $5,000,000 and the raffle-triggering amount is $10,000,000. Referring to game playslip 1100 (FIG. 11), The Pick 6 game comprises a player selecting six indicia from a set of game indicia, 1 through 55. FIG. 12 illustrates the lottery game ticket 1200 corresponding to game playslip 1100. For this first play (or drawing), the player selects 1-9-11-22-33-44.

Figure 13:
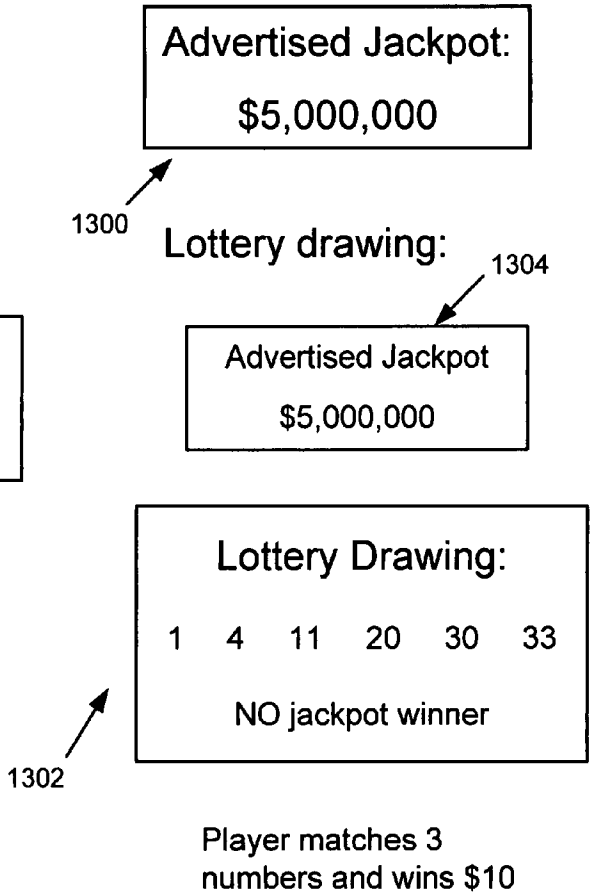
FIG. 13 is an illustration of a first game drawing and associated results for the playslip and ticket of FIGS. 11 and 12.
Figure 14:
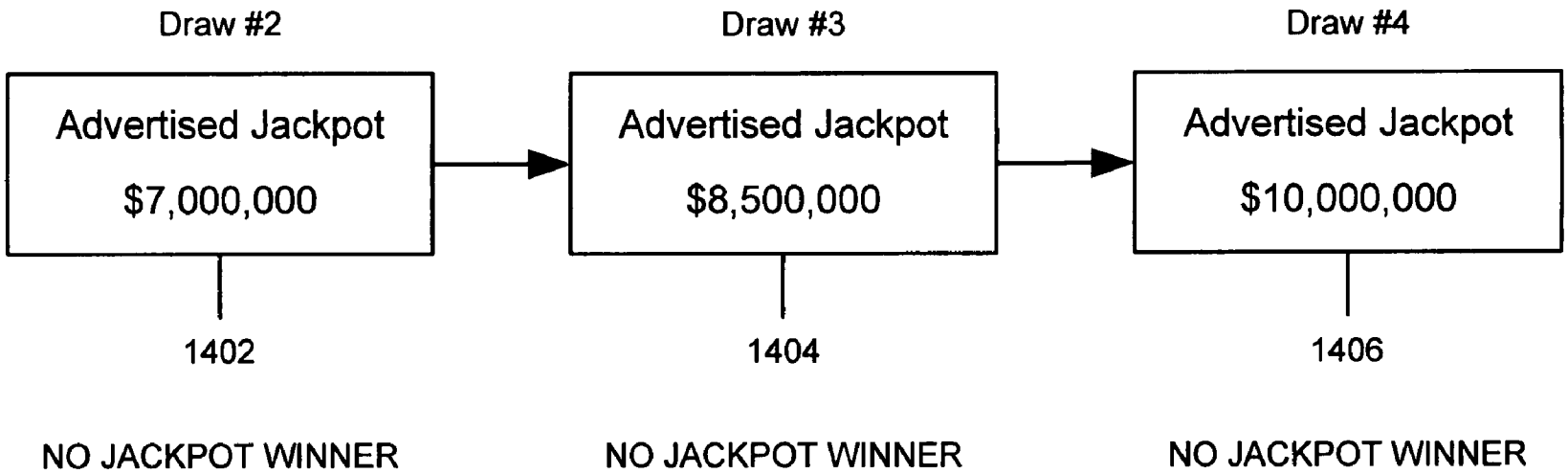
FIG. 14 is a flowchart illustrating the accumulation of the jackpot for the combination lottery/raffle game based on game drawings 2-4.

FIG. 13 illustrates the results of the first drawing: 14-11-20-30-33. Based on prize table 1000, the player wins $10 for matching three of the numbers. Because there is no jackpot winner, the jackpot accumulates and another play or drawing occurs. FIG. 14 illustrates the accumulation of the jackpot as subsequent drawings (1402, 1406, and 1408) fail to produce a jackpot winner: second drawing 1402 ($7,000,000); third drawing 1404 ($8,500,000); and fourth drawing 1404 ($10,000,000). After fourth drawing 1404, the raffle feature is triggered because the raffle-trigger threshold has been reached.

FIG. 15 illustrates a game playslip 1500 for the fifth drawing. FIG. 16 illustrates the corresponding game ticket 1600, which identifies the player selections: 1-9-11-22-33-44. Because the progressive jackpot has reached the raffle-triggering threshold and the raffle game has kicked-in, a unique raffle number (112-225-147) is generated for this play for the raffle game and printed on game ticket 1700.

FIG. 17 illustrates the results 1702 of the fifth drawing: 9-20-27-44-47-55. As further illustrated at block 1704 in FIG. 17, the advertised jackpot is still $10,000,000 but, because the raffle-triggering threshold was reached, there are two additional raffle prizes of $1,000,000. Based on prize table 1000, the player wins $200 for matching four numbers. Because there is not a jackpot winner, the game continues with a jackpot of $10,000,000 and five more $1,000,000 raffle prizes.

FIG. 18 illustrates a game playslip 1800 for the sixth drawing. FIG. 19 illustrates the corresponding game ticket 1900, which identifies the player selections, 1-9-11-22-33-44, and the new unique number for the raffle game (999-727-333). FIG. 20 illustrates the results 2002 of the sixth drawing: 1-9-11-22-33-44. As illustrated in FIG. 20 at block 2004, the accumulated monies for this drawing resulted in the addition of five new $1,000,000 raffle prizes. The player wins the $10,000,000 jackpot because all six numbers were matched. Because the drawing produced a jackpot winner, the raffle drawing is triggered and seven additional raffle numbers are chosen.

Figure 21:
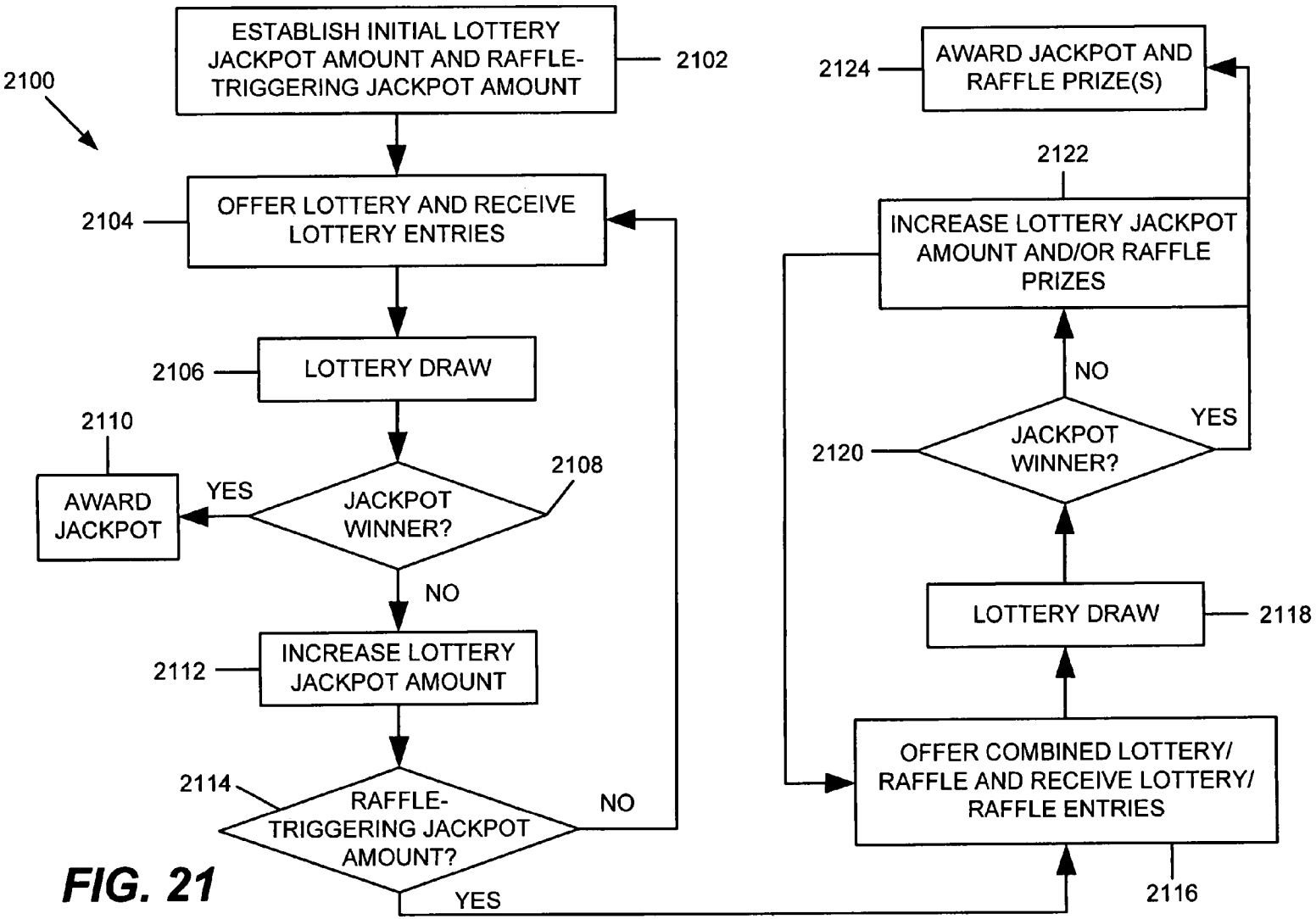
FIG. 21 is a flowchart illustrating the general framework and/or operation of a method for a further embodiment of a combination lottery/raffle game.

FIG. 21 illustrates another embodiment of a combined lottery/raffle game implemented with a progressive lottery game. At block 2102, an initial lottery jackpot amount and a raffle-triggering jackpot amount are established. At block 2104, only the progressive lottery game is offered. After the lottery entries are received, a lottery draw is performed (block 2106). If the lottery drawing produces a jackpot winner (decision block 2108), at block 2110, the jackpot is awarded. If, however, the lottery drawing does not produce a jackpot winner, the progressive jackpot accumulates.

As illustrated at decision block 2114, only the progressive lottery is offered until the jackpot reaches or exceeds the raffle-triggering jackpot amount. If the accumulated jackpot does not reach or exceed the raffle-triggering jackpot amount, the next play or drawing does not include the raffle feature. If the accumulated jackpot reaches or exceeds the raffle-triggering jackpot amount, the raffle feature kicks-in, at decision block 2116, where the combined lottery/raffle game is offered and entries received. In the combined game, as mentioned in detail above, each game entry includes a unique raffle number generated by the lottery. At block 2118, the lottery drawing is performed and, if a jackpot winner is produced (decision block 2120), the raffle drawing is performed at block 2124. If no jackpot winner is produced, at block 2122, the lottery jackpot and/or the raffle prizes may be increased. In the example above, the lottery jackpot was maintained, while all accumulated funds were applied to additional raffle prizes. It should be appreciated that, in alternative embodiments, the lottery jackpot may also be increased and the raffle prizes may be increased in number and/or value. When a jackpot winner is not produced, the combined lottery/raffle game is offered again (with the increased prizes), until a jackpot winner is produced.

The foregoing description presents only exemplary embodiments. Those of ordinary skill in the art will readily recognize that the combined lottery/raffle game may be implemented in numerous ways, using any lottery or lotto game, any raffle-type game, and any triggering event. Furthermore, it should be appreciated that the combined lottery/raffle game may be implemented, at least partially, via a computer-implemented system, method, or apparatus, in which case various aspects of the features described above may embody functions, features, logic, processes, methods, and/or steps which may be implemented in hardware, software, or any combination thereof by operating a computer or other processing device to execute a sequence of machine-readable instructions. The instructions can reside in various types of signal-bearing or data storage primary, secondary, or tertiary media. The media may comprise, for example, RAM (not shown) accessible by, or residing within, the components of the system. Whether contained in RAM, a diskette, or other secondary storage media, the instructions may be stored on a variety of machine-readable data storage media, such as DASD storage (e.g., a conventional "hard drive" or a RAID array), magnetic tape, electronic read-only memory (e.g., ROM, EPROM, or EEPROM), flash memory cards, an optical storage device (e.g. CD-ROM, WORM, DVD, digital optical tape), paper "punch" cards, or other suitable data storage media including digital and analog transmission media.

While the invention has been particularly shown and described with reference to various described embodiments, it will be understood by those skilled in the art that various changes in form and detail may be made without departing from the spirit and scope of the present invention as set forth in the following claims.

What is claimed is:

1. A method for a progressive lottery game performed at least in part via a processor comprising the steps of:

establishing an initial amount for a lottery jackpot and a raffle-triggering jackpot amount for a progressive lottery game;

performing at least in part via the processor a first lottery draw for the progressive lottery game;

when there is not a jackpot winner based on the first lottery draw, increasing the lottery jackpot to a new amount;

when the new amount exceeds the raffle-triggering jackpot amount, combining a raffle game with the progressive lottery game for a subsequent lottery draw and holding the lottery jackpot amount at the raffle-triggering amount;

continuing the progressive lottery game with subsequent lottery draws until the held lottery jackpot amount is won; and conducting the raffle game after the held lottery jackpot is won.

2. The method of claim 1, wherein the step of performing the raffle draw comprises selecting at least one unique raffle number.

3. The method of claim 1, further comprising the step of:

increasing the raffle prizes for the raffle game for each of the subsequent lottery draws that does not produce a jackpot winner.

4. The method of claim 3, wherein the step of increasing the raffle prizes for the raffle game comprises adding at least one additional raffle prize.

* * * * *